US010092090B1

(12) United States Patent
Chen

(10) Patent No.: US 10,092,090 B1
(45) Date of Patent: Oct. 9, 2018

(54) APPARATUS FOR ADJUSTING THE ELEVATION AND ANGLE OF A TABLE

(71) Applicant: TCT Nanotec Co., Ltd., Taichung (TW)

(72) Inventor: Yi-I Chen, Taichung (TW)

(73) Assignee: TCT Nanotec Co., Ltd., Taichung (TW)

( * ) Notice: Subject to any disclaimer, the term of this patent is extended or adjusted under 35 U.S.C. 154(b) by 0 days.

(21) Appl. No.: 15/682,619

(22) Filed: Aug. 22, 2017

(51) Int. Cl.

| | |
|---|---|
| ***A47B 9/00*** | (2006.01) |
| ***A47B 13/08*** | (2006.01) |
| ***A47B 39/02*** | (2006.01) |
| ***A47B 41/02*** | (2006.01) |
| ***A47B 9/20*** | (2006.01) |

(52) U.S. Cl.
CPC ..... *A47B 13/081* (2013.01); *A47B 9/20* (2013.01); *A47B 39/02* (2013.01); *A47B 41/02* (2013.01); *A47B 2200/0042* (2013.01); *A47B 2200/0043* (2013.01); *A47B 2200/0061* (2013.01); *A47B 2200/0062* (2013.01); *A47B 2200/0078* (2013.01)

(58) Field of Classification Search
CPC ..... A47B 13/081; A47B 9/20; A47B 41/02; A47B 39/02; A47B 2200/0078; A47B 2200/0062; A47B 2200/0061; A47B 2200/0043; A47B 2200/0042
See application file for complete search history.

(56) References Cited

U.S. PATENT DOCUMENTS

| | | | | |
|---|---|---|---|---|
| 9,486,070 | B2 * | 11/2016 | Labrosse | A47B 21/02 |
| 2006/0065163 | A1 * | 3/2006 | Chi | A47B 21/03 108/7 |
| 2014/0096706 | A1 * | 4/2014 | Labrosse | A47B 21/02 108/21 |
| 2016/0127809 | A1 * | 5/2016 | Sigal | H04Q 9/00 340/870.07 |
| 2016/0170402 | A1 * | 6/2016 | Lindstrom | A47B 9/00 700/275 |
| 2016/0353880 | A1 * | 12/2016 | Sigal | A47B 21/02 |
| 2017/0013415 | A1 * | 1/2017 | Sigal | H04W 4/043 |
| 2017/0354244 | A1 * | 12/2017 | Lee | A47B 9/20 |

* cited by examiner

*Primary Examiner* — Charles R Kasenge
(74) *Attorney, Agent, or Firm* — Alan D. Kamrath; Kamrath IP Lawfirm, P.A.x

(57) ABSTRACT

A multi-task table includes at least one board and an apparatus for adjusting the elevation and angle of the board. The apparatus includes an elevating unit, a tilting unit, a control panel, a setting module, a calculating module and a central control module. The elevating unit is used to move the board. The tilting unit is used to tilt the board. The control panel is used to show data about a user. The setting module is used to receive and store the data via the control panel. The calculating module is used to calculate values of elevation and angle of the board suitable for playing games, writing, reading and stand. The central control module is used to control the elevating unit, the tilting unit, the control panel, the setting module and the calculating module.

8 Claims, 6 Drawing Sheets

APPARATUS FOR ADJUSTING THE ELEVATION AND ANGLE OF A TABLE

BACKGROUND OF INVENTION

1. Field of Invention

The present invention relates to a table and, more particularly, to an apparatus for adjusting the elevation and angle of a table.

2. Related Prior Art

At a user's discretion, the elevation of a table can electrically or manually be set for various tasks such as reading, writing, playing a board game or operating a computer. However, the setting at the user's discretion is not without any problems. Firstly, it is often subjective and improper. The user would be forced to huddle if the elevation of the table is too low, or lift the shoulders and hence overstress the muscles in the shoulders and neck if the elevation of the table is too high. Secondly, the elevation of the table is often set for a value and kept at that value no matter what tasks are conducted on the table. However, the elevation of the table would better be set for different values according to various tasks such as reading, writing, playing a board game and operating a computer. Hence, the user is in improper gestures while using the table, and the distance and angle from the user's eyes to an observed object such as a book, a piece of paper, a game board and a screen changes considerably. Thirdly, the elevation of the table is not suitable for the user while standing. Therefore, the user is bound to sit for a long period time while using the table. Fourthly, different users have to set the elevation of the table for different values, and this is inconvenient.

The present invention is therefore intended to obviate or at least alleviate the problems encountered in prior art.

SUMMARY OF INVENTION

It is the primary objective of the present invention to provide a multi-task table with an apparatus for adjusting the elevation and angle of a board thereof.

To achieve the foregoing objective, the apparatus includes an elevating unit, a control panel, a setting module, an analyzing calculating module and a central control module. The elevating unit is used for moving the board. The control panel is provided on the multi-task table and includes a screen and an icon area. The icon area includes a power supply icon, a direction icon set, a setting icon, and a mode icon set. The direction icon set includes an upward icon and a downward icon. The mode icon set includes a writing icon, a reading icon and a standing icon. The setting module is used for executing a name-setting program, a unit-setting program and a height program when the setting icon is operated, thereby allowing a user to operate the direction icon set and the power supply icon to enter the user's data including a name, a unit of height and a height-representing number. Moreover, the setting module builds a user database for the user to store the user's data. The calculating module is used for executing an elevation-calculating program to calculate values of elevation of the multi-task table suitable for writing, reading and standing based on the user's height and predetermined parameters of the multi-task table. Furthermore, the calculating module stores the values of elevation in the user database. The central control module is used for controlling the elevating unit, the control panel, the setting module, the user database and the calculating module. When the writing icon is operated, the central control module actuates the elevating unit to adjust the elevation of the board based on the value of elevation suitable for writing stored in the user database. When the reading icon is operated, the central control module actuates the elevating unit to adjust the elevation of the board based on the value of elevation suitable for reading stored in the user database. When the standing icon is operated, the central control module actuates the elevating unit to adjust the elevation of the board based on the value of elevation suitable for standing stored in user database.

In another aspect, the calculating module increases each of the values of elevation when the upward icon is operated and reduces each of the values of elevation when the downward icon is operated.

In another aspect, the control panel includes a touch panel, and the icons are provided on the touch panel. Alternatively, the icons are buttons.

In another aspect, the apparatus further includes a power-controlling module electrically connected to the central control module and the elevating unit. The power-controlling module receives an ON/OFF signal from the control module and accordingly turns on or off the apparatus. When the apparatus is turned on, the central control module actuates the power supply icon to show that the apparatus is in a standby state. When the power supply icon is operated, the central control module actuates all of the icons.

In another aspect, the icon area further includes a game icon. The elevation-calculating program calculates a value of elevation of the board suitable for playing games. When the game icon is operated, the central control module instructs the elevating unit to adjust the elevation of the primary board according to the value of elevation of the board suitable for playing games.

In another aspect, the apparatus further includes a tilting unit for changing the angle of the primary board under control of the central control module.

In another aspect, the calculating module executes an angle-calculating program to calculate a value of angle of the primary board suitable for writing based on the user's height and the predetermined parameters of the multi-task table. When the writing icon is operated, the central control module synchronously actuates the elevating unit and the tilting unit to adjust the elevation and angle of the board suitable for writing.

In another aspect, the calculating module executes the angle-calculating program to calculate a value of angle of the primary board suitable for reading based on the user's height and the predetermined parameters of the multi-task table. When the reading icon is operated, the central control module synchronously actuates the elevating unit and the tilting unit to adjust the elevation and angle of the board suitable for reading.

Advantageously, the apparatus helps a user set the elevation to a proper value according to a desired task such as reading, writing, playing a board game, operating a computer and standing. Furthermore, the apparatus changes the angle of the table while adjusting the elevation of the table to provide the user with a proper elevation and angle for the desired task. Moreover, the apparatus automatically sets the elevation and angle of the table to different values for different users.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
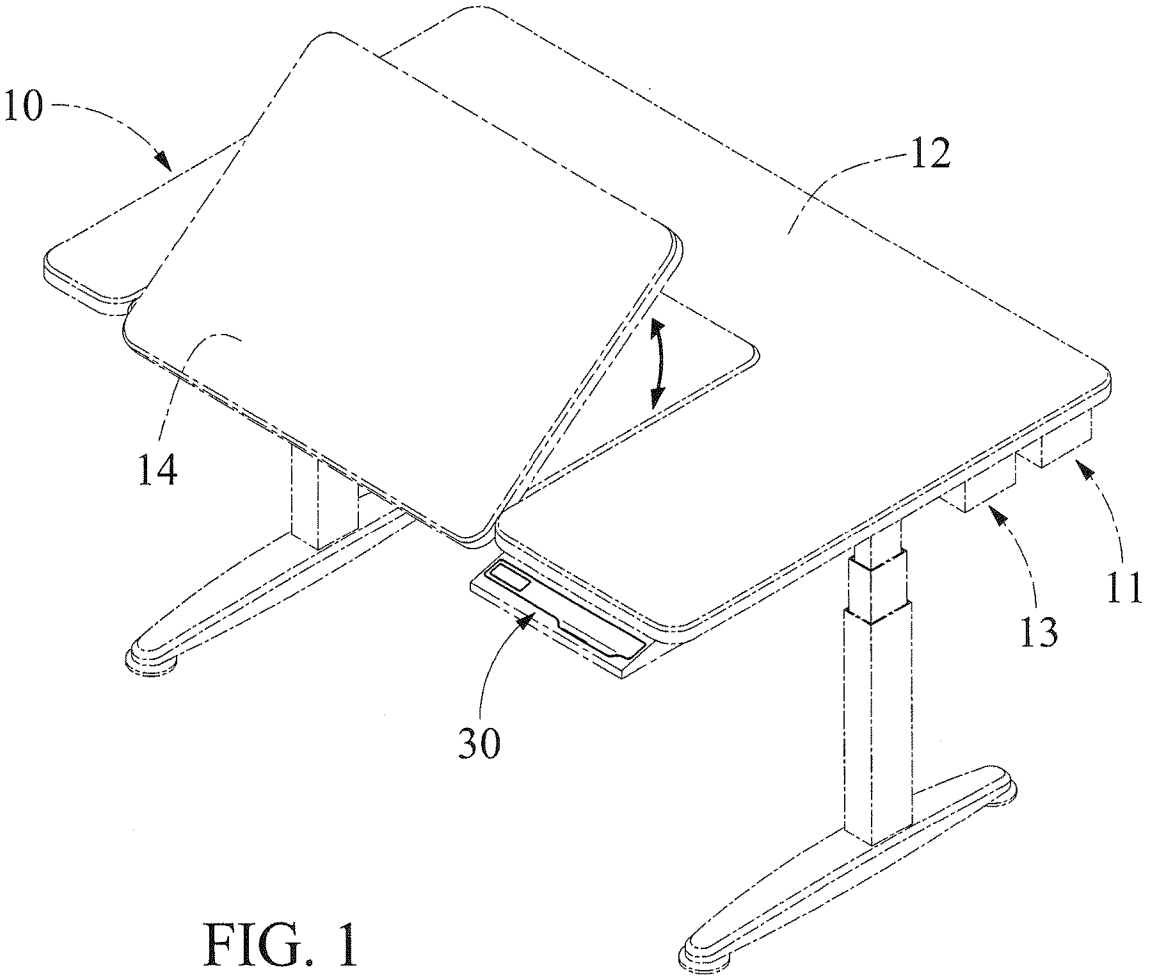
FIG. 1 is a perspective view of an apparatus for adjusting the elevation and angle of a table according to the preferred embodiment of the present invention.
Figure 2:
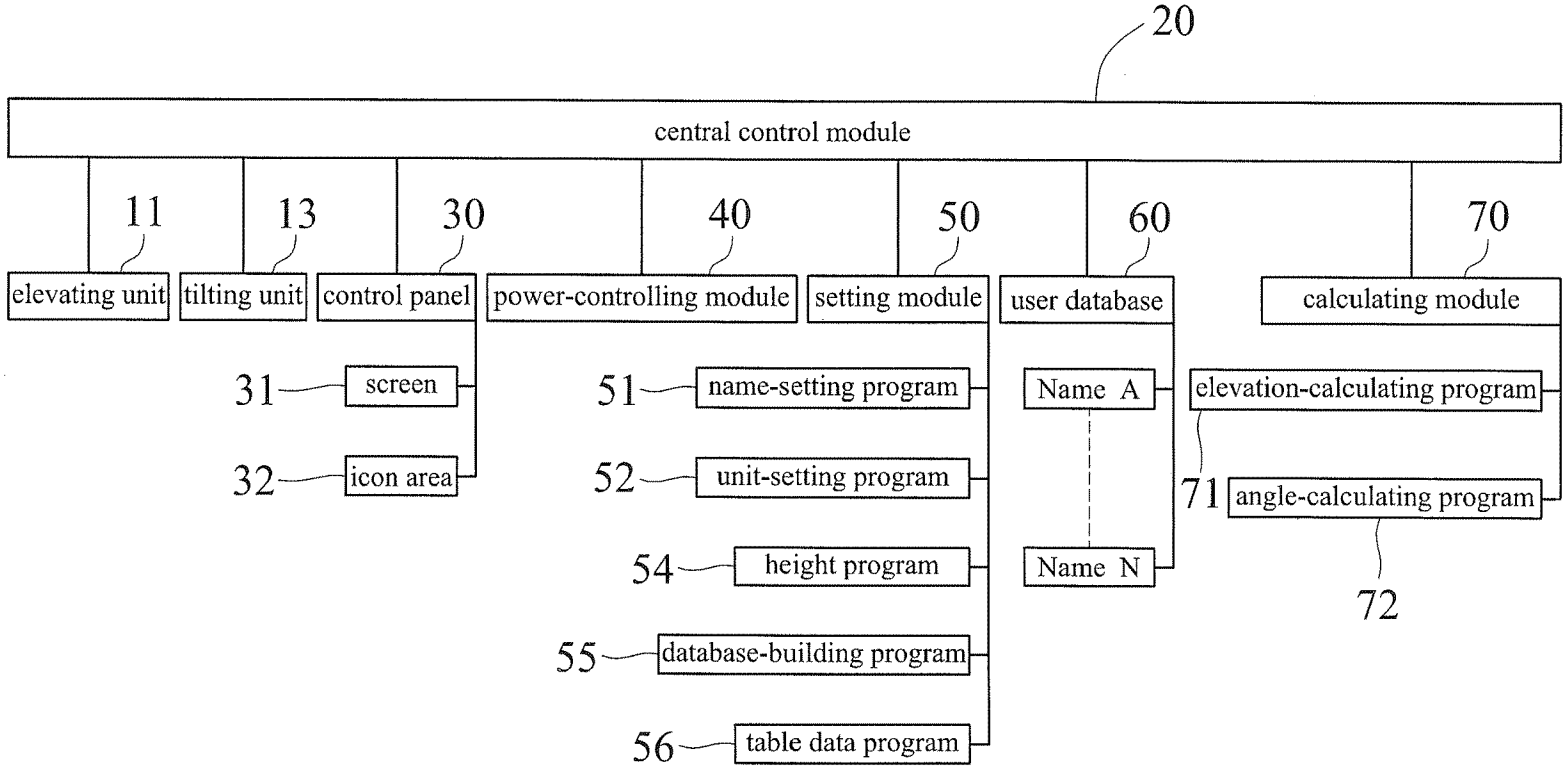
FIG. 2 is a block diagram of the apparatus shown in FIG. 1.
Figure 3:
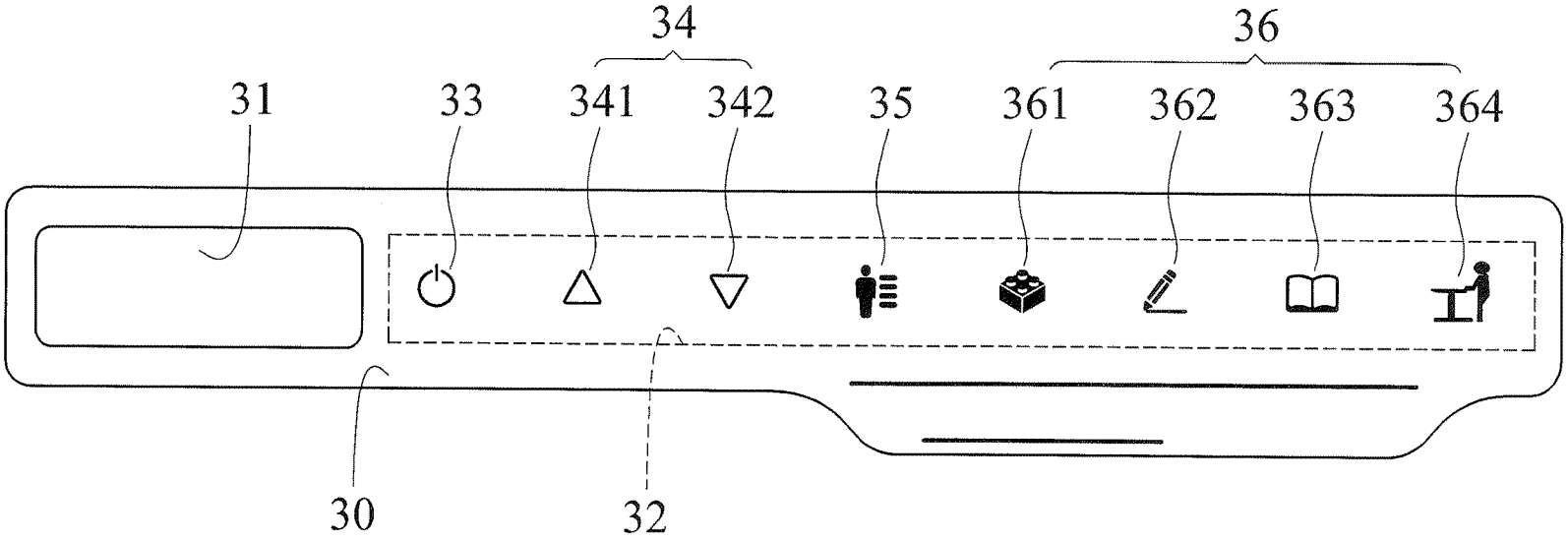
FIG. 3 is a front view of a control panel used in the apparatus shown in FIG. 1.

Referring to FIGS. 1 through 3, a multi-task table 10 includes a primary board 12, a secondary board 14 pivotally connected to primary board 12, an elevating unit 11 for adjusting the elevation of primary board 12 and a tilting unit 13 for adjusting the angle of secondary board 14 relative to primary board 12.

Multi-task table 10 further includes an apparatus for adjusting the elevation and angle thereof according to the preferred embodiment of the present invention. The adjusting apparatus includes a central control module 20, a control panel 30, a power-controlling module 40, a setting module 50, a user database 60 and a calculating module 70. Central control module 20 is electrically connected to and controls elevating unit 11, tilting unit 13, control panel 30, power-controlling module 40, setting module 50, user database 60 and calculating module 70.

Control panel 30 is provided near an edge of primary board 12 of multi-task table 10. Control panel 30 includes a screen 31 and an icon area 32. Screen 31 shows data in the form of numbers and words about the adjusting apparatus including but not limited to as the elevation of primary board 12 and the name and height of a user. Icon area 32 includes a power supply icon 33, a direction icon set 34, a setting icon 35, a mode icon set 36. Power supply icon 33 is operable to turn on and off the adjusting apparatus and enter data about a user. Direction icon set 34 includes an upward icon 341 and a downward icon 342. Upward icon 341 is operable to lift primary board 12, and downward icon 342 is operable to lower primary board 12. Upward and downward icons 341 and 342 are operable to change the content shown on screen 31. Setting icon 35 is operable to turn on setting module 50. Mode icon set 36 includes a game icon 361, a writing icon 362, a reading icon 363 and a standing icon 364. Game icon 361 is operable to adjust the elevation of primary board 12 to a value suitable for playing games. Writing icon 362 is operable to adjust the elevation of primary board 12 to a value for suitable writing. Reading icon 363 is operable to adjust the elevation of primary board 12 to a value suitable for reading. Standing icon 364 is operable to adjust the elevation of primary board 12 to a value suitable for standing. Control panel 30 is preferably a touch panel, and the icons of icon area 32 are preferably touch-type icons shown on such as touch panel. The icons of icon area 32 can be buttons in another embodiment.

Figure 4:
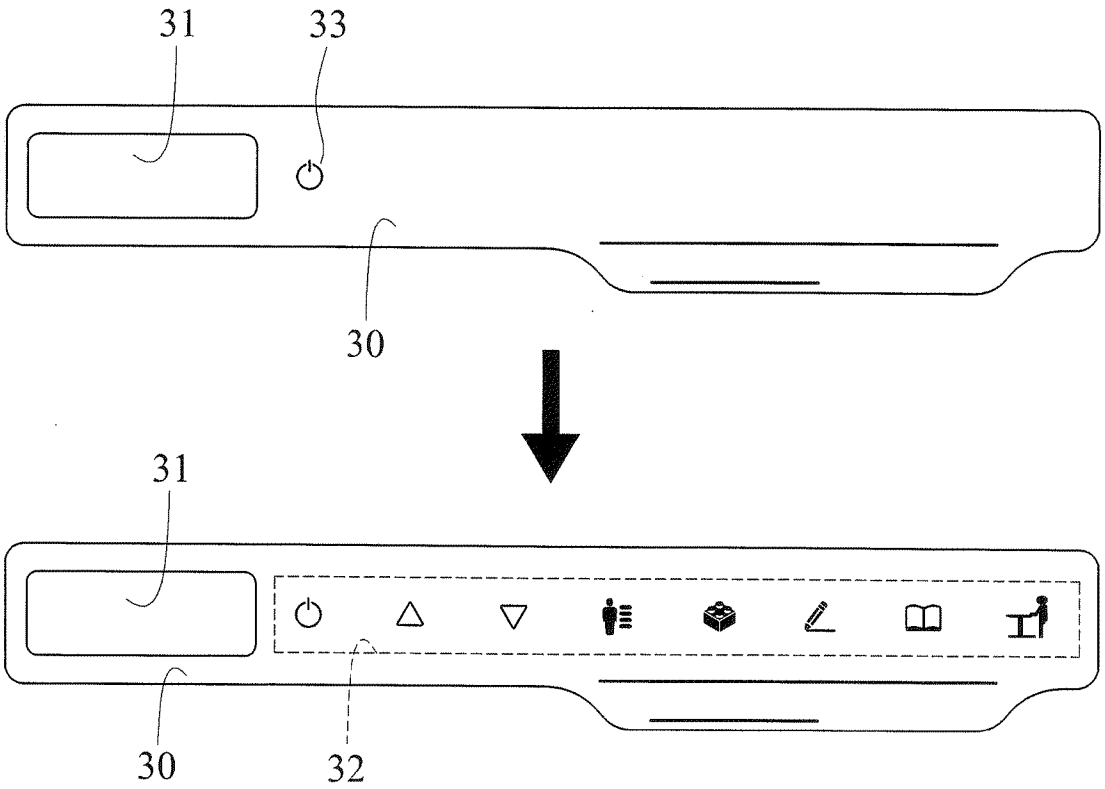
FIG. 4 is a front view of change in the control panel shown in FIG. 3.

Referring to FIG. 4, power-controlling module 40 receives an ON/OFF signal from elevating unit 11 and accordingly turns on/off the apparatus. In the preferred embodiment, control panel 30 is a touch panel, and power supply icon 33 of control panel 30 shows that the entire apparatus is in a standby state when the apparatus is turned on. Central control module 20 receives an ON command and accordingly executes a homepage-showing program to show icon area 32 on control panel 30 when power supply icon 33 is touched. Screen 31 will show the state of the apparatus such as standby and ON if icon area 32 of control panel 30 includes buttons.

Figure 5:
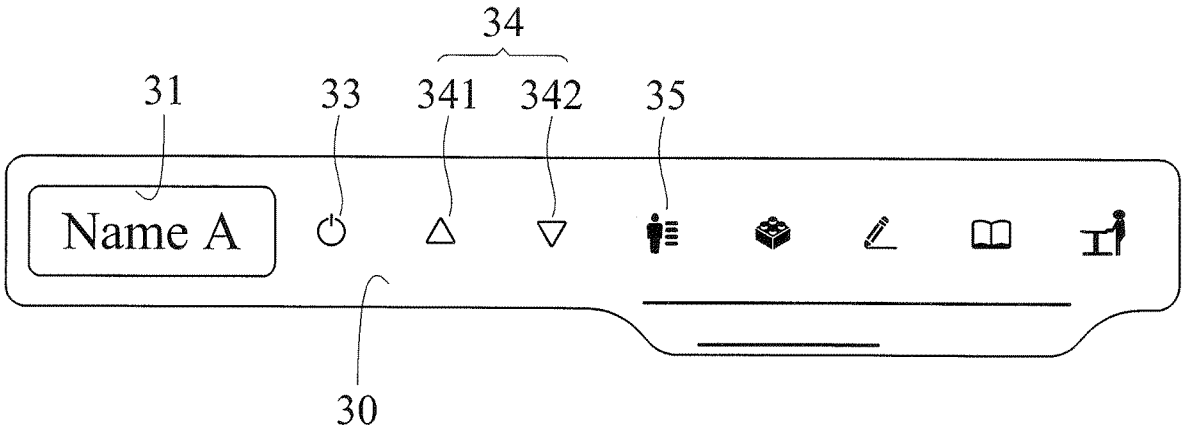
FIG. 5 is a front view of the control panel in another state other than shown in FIG. 3.

Referring to FIGS. 2 and 5, central control module 20 instructs setting module 50 to execute a name-setting program 51 to receive a user's name when setting icon 35 is touched. The user touches upward icon 341 and/or downward icon 342 and power supply icon 33 to enter his or her name. For example, but not for any limiting purposes, name-setting program 51 shows letters on screen 31, and the user touches upward icon 341 and/or downward icon 342 to sequentially select some from the letters to spell his or her name, and touches power supply icon 33 to confirm his or her name.

Figure 6:
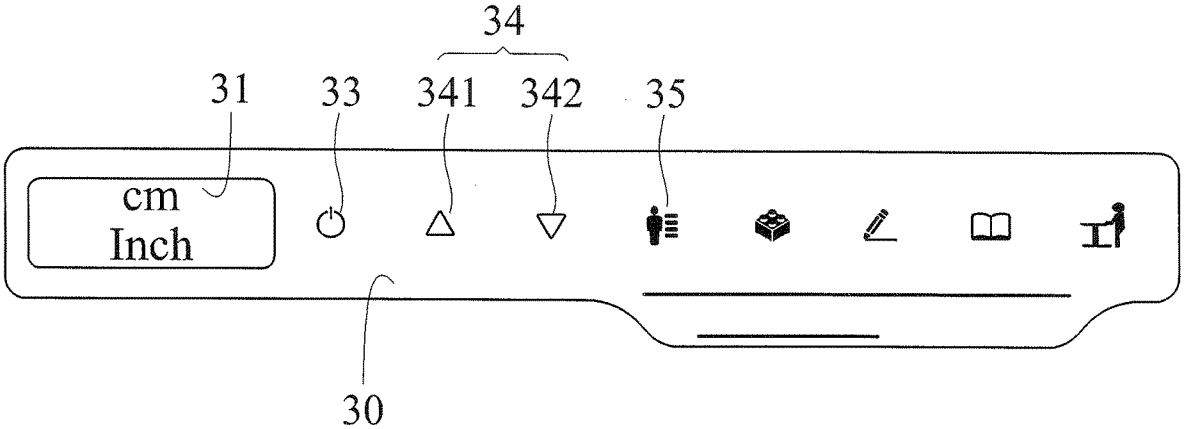
FIG. 6 is a front view of the control panel in another state other than shown in FIG. 5.

Then, referring to FIGS. 2 and 6, setting module 50 executes a unit-setting program 52 to show "cm" and "inch" on screen 31. The user touches upward icon 341 and/or downward icon 342 and power supply icon 33 to select one from the units.

Figure 7:
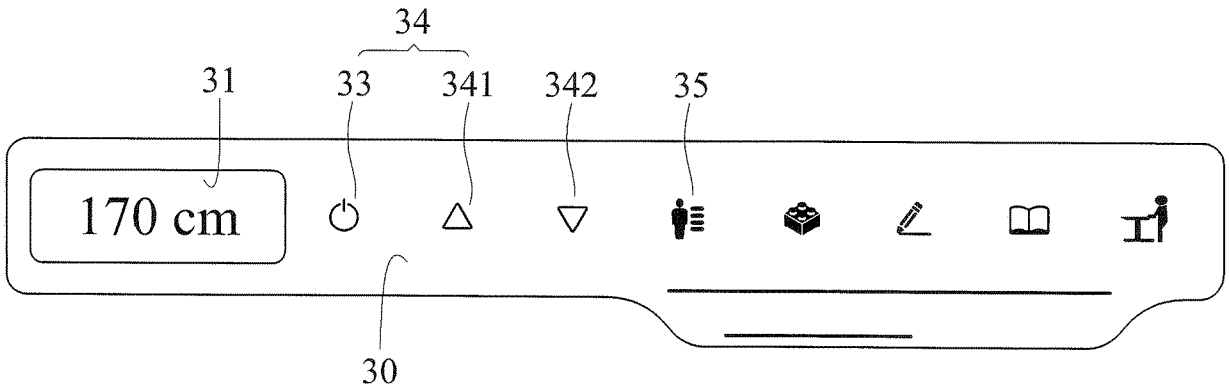
FIG. 7 is a front view of the control panel in another state other than shown in FIG. 6.

Then, referring to FIGS. 2 and 7, setting module 50 executes a height program 54 to receive a number representing the user's height. The user touches upward icon 341 and/or downward icon 342 and power supply icon 33 to enter the height-representing number. For example, but not for any limiting purposes, "cm" is selected to be the unit for height, and height program 54 shows a hundreds digit, a tens digit, a unit digit, a decimal point and a decimal digit on screen 31, and the user touches upward icon 341 and/or downward icon 342 to select each of the digits to enter the height-representing number and touches power supply icon 33 to confirm the height-representing number.

Referring to FIG. 2, after receiving the user's data such as the name, the height-representing number and the unit of height, setting module 50 executes a database-setting program 55 to build a specific user database 60 for the user and store the user's data. Setting module 50 executes a table data program 56 to receive and store the specification of multi-task table 10 that is entered by the manufacturer. The specification includes a model number and the length of posts, the thickness of primary board 12, the thickness of secondary board 14 and a maximum stroke of the change of the elevation of primary board 12 related to the model number.

Referring to FIG. 2, calculating module 70 executes an elevation-calculating program 71 for calculating values of elevation of primary board 12 suitable for playing games, writing, reading and standing based on the height-representing number and the specification of multi-task table 10. However, upward icon 341 or downward icon 342 can be touched to instruct calculating module 70 to increase or reduce the values of elevation of primary board 12 calculated by calculating module 70. The values of elevation of primary board 12 suitable for playing games, writing, reading and standing regarding the user are stored in user database 60.

Referring to FIGS. 1 and 2, calculating module 70 executes an angle-calculating program 72 for calculating values of angle of secondary board 14 relative to primary board 12 suitable for playing games, writing, reading and standing based on the height-representing number and the specification of multi-task table 10. Writing icon 362 or reading icon 363 can be touched to instruct central control module 20 to actuate elevating unit 11 to adjust the elevation of primary board 12 and actuate tilting unit 13 to adjust the angle of secondary board 14 relative to primary board 12 so that multi-task table 10 is at an elevation and angle suitable for playing games, writing, reading or standing.

After user database 60 is built and the specification of multi-task table 10 is entered, the user can operate control panel 30 in the following manner.

Upward icon 341 or downward icon 342 is touched to enter the user's name or change a user's name shown on screen 31. Then, power supply icon 33 is touched to confirm the user's name. Central control module 20 actuates user database 60 corresponding to the user's name.

When game icon 361 is touched, central control module 20 actuates elevating unit 11 and tilting unit 13 to adjust the elevation and angle of multi-task table 10 based on the values of elevation and angle suitable for playing games stored in user database 60. Thus, the user can comfortably play games at multi-task table 10.

When writing icon 362 is touched, central control module 20 actuates elevating unit 11 and tilting unit 13 to adjust the elevation and angle of multi-task table 10 based on the values of elevation and angle suitable for writing stored in user database 60. Thus, the user can comfortably write at multi-task table 10.

When reading icon 363 is touched, central control module 20 actuates elevating unit 11 and tilting unit 13 to adjust the elevation and angle of multi-task table 10 based on the values of elevation and angle suitable for reading stored in user database 60. Thus, the user can comfortably read at multi-task table 10.

When standing icon 364 is touched, central control module 20 actuates elevating unit 11 and tilting unit 13 to adjust the elevation and angle of multi-task table 10 based on the values of elevation and angle suitable for standing stored in user database 60. Thus, the user can comfortably use multi-task table 10 while standing.

The values of elevation and angle suitable for playing games, writing, reading or standing are shown on screen 31.

In the preferred embodiment, multi-task table 10 includes primary board 12 and secondary board 14. Elevating unit 11 changes the elevation of primary board 12, and tilting unit 13 tilts secondary board 14 relative to primary board 12, which is kept horizontally. However, in another embodiment, multi-task table 10 includes only primary board 12, and elevating unit 11 changes the elevation of primary board 12, and tilting unit 13 tilts the angle primary board 12.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An apparatus for adjusting the elevation and angle of a multi-task table that comprises at least one board (12), the apparatus comprising:

an elevating unit (11) for moving the board (12);

a control panel (30) provided on the multi-task table (10) and comprising:

a screen (31); and an icon area (32) comprising:

a power supply icon (33);

a direction icon set (34) comprising a upward icon (341) and a downward icon (342);

a setting icon (35), and a mode icon set (36) comprising a writing icon (362), a reading icon (363) and a standing icon (364);

a setting module (50) for executing a name-setting program (51), a unit-setting program (52) and a height program (54) when the setting icon (35) is operated, thereby allowing a user to operate the direction icon set (34) and the power supply icon (33) to enter the user's data including a name, a unit of height and a height-representing number, wherein the setting module (50) builds a user database (60) for the user to store the user's data;

a calculating module (70) for executing an elevation-calculating program (71) to calculate values of elevation of the multi-task table (10) suitable for writing, reading and standing based on the user's height and predetermined parameters of the multi-task table (10) and store the values of elevation in the user database (60); and a central control module (20) for controlling the elevating unit (11), the control panel (30), the setting module (50), the user database (60) and the calculating module (70);

wherein when the writing icon (362) is operated, the central control module (20) actuates the elevating unit (11) to adjust the elevation of the board (12) based on the value of elevation suitable for writing stored in the user database (60);

wherein when the reading icon (363) is operated, the central control module (20) actuates the elevating unit (11) to adjust the elevation of the board (12) based on the value of elevation suitable for reading stored in the user database (60);

wherein when the standing icon (364) is operated, the central control module (20) actuates the elevating unit (11) to adjust the elevation of the board (12) based on the value of elevation suitable for standing stored in user database (60).

2. The apparatus according to claim 1, wherein the calculating module (70) increases each of the values of elevation when the upward icon (341) is operated and reduces each of the values of elevation when the downward icon (342) is operated.

3. The apparatus according to claim 1, wherein the control panel (30) comprises a touch panel, wherein the icons are provided on the touch panel.

4. The apparatus according to claim 1, wherein the icons are buttons.

5. The apparatus according to claim 1, further comprising a power-controlling module (40) electrically connected to the elevating unit (11) and the central control module (20), wherein the power-controlling module (40) receives an ON/OFF signal from the control module and accordingly turns on or off the apparatus, wherein when the apparatus is turned on, the central control module (20) actuates the power supply icon (33) to show that the apparatus is in a standby state, wherein when the power supply icon (33) is operated, the central control module (20) actuates all of the icons.

6. The apparatus according to claim 1, wherein the icon area (32) further comprising a game icon (361), wherein the calculating module (70) executes the elevation-calculating program (71) to calculate a value of elevation of the board (12) suitable for playing games, wherein when the game icon (361) is operated, the central control module (20) instructs the elevating unit (11) to adjust the elevation of the primary board (12) according to the value of elevation of the board (12) suitable for playing games.

7. The apparatus according to claim 1, further comprising a tilting unit (13) for changing the angle of the primary board (12) under control of the central control module (20), wherein the calculating module (70) executes an angle-calculating program (72) to calculate a value of angle of the primary board (12) suitable for writing based on the user's height and the predetermined parameters of the multi-task table (10), wherein when the writing icon (362) is operated, the central control module (20) synchronously actuates the elevating unit (11) and the tilting unit (13) to adjust the elevation and angle of the board (12) suitable for writing.

8. The apparatus according to claim 1, further comprising a tilting unit (13) for changing the angle of the primary board (12) under control of the central control module (20), wherein the calculating module (70) executes an angle-calculating program (72) to calculate a value of angle of the primary board (12) suitable for reading based on the user's height and the predetermined parameters of the multi-task table (10), wherein when the reading icon (363) is operated, the central control module (20) synchronously actuates the elevating unit (11) and the tilting unit (13) to adjust the elevation and angle of the board (12) suitable for reading.

* * * * *